US006225563B1

(12) United States Patent
Poulsen

(10) Patent No.: US 6,225,563 B1
(45) Date of Patent: May 1, 2001

(54) AUDIO SIGNAL INTERCONNECT CABLE

(76) Inventor: Peder U. Poulsen, 197 Beaverdam Access Rd., Stratford, CT (US) 06614

( * ) Notice: Subject to any disclaimer, the term of this patent is extended or adjusted under 35 U.S.C. 154(b) by 0 days.

(21) Appl. No.: 09/290,476

(22) Filed: Apr. 12, 1999

(51) Int. Cl.[7] ..... H01B 7/08
(52) U.S. Cl. ..... 174/117 FF
(58) Field of Search ..... 174/117 FF, 27, 174/36, 108, 117 F, 117 R

(56) References Cited

U.S. PATENT DOCUMENTS 479,525 * 7/1892 Perrine ..... 174/27
2,267,455 * 12/1941 Gerhard ..... 174/27
2,462,887 * 3/1949 Muller ..... 174/27
2,847,499 * 8/1958 Peterson ..... 174/27 X
3,168,617 * 2/1965 Richter ..... 174/117 FF
3,679,812 * 7/1972 Owens ..... 174/108
3,757,029 * 9/1973 Marshall ..... 174/36
5,393,933 * 2/1995 Goertz ..... 174/117 R
5,424,491 * 6/1995 Walling et al. ..... 174/113 R
6,005,193 * 12/1999 Markel ..... 174/117 FF

* cited by examiner

*Primary Examiner*—Dean A. Reichard
*Assistant Examiner*—Chau N. Nguyen
(74) *Attorney, Agent, or Firm*—John H. Crozier

(57) ABSTRACT

In a preferred embodiment, an audio signal interconnect cable, including: at least two thin, flat conductors and a flexible jacket surrounding the at least two, thin, flat, conductors. Each of the at least two, thin, flat conductors may have a width on the order of from about 2 to about 6 mm and a thickness on the order of from about 50 to about 100 microns.

6 Claims, 1 Drawing Sheet

AUDIO SIGNAL INTERCONNECT CABLE

FIELD OF THE INVENTION

The present invention relates to audio signal cables in general and, more particularly, but not by way of limitation, to a novel so-called audio signal interconnect cable.

BACKGROUND ART

Interconnect cables transport low level voltage signals from a source such as a microphone or a tape or record player to a load such as a pre-amplifier or a power amplifier. The cable must be able to transfer the signal without changing its amplitude and shape within a frequency band covering at least the audible range from 20 through 20,000 Hertz. However, recent advances in amplifier and loudspeaker technology have demonstrated audible benefits if cables are able to transfer signals at frequencies beyond the audible range without distortion such as high frequency roll-off and frequency dependent phase shift.

U.S. Pat. No. 5,393,933 describes an audio loudspeaker cable which achieves an extremely low series inductance combined with a high relative capacitance to obtain a characteristic impedance on the order of magnitude of 2–10 ohms. The effect of this is an almost total absence of roll-off and ringing caused by repeated signal reflections. In addition, the cable has a low loop resistance in order to support a powerful, undistorted bass and lower mid range. According to the patent, these characteristics are achieved by means of a sandwich construction of two relatively heavy, wide conductors separated by a thin layer of dielectric material. Because of the required low loop resistance, this cable is basically a power cable which is able to transmit signals of several amperes without excessive power loss.

Since the signal strength in an audio interconnect cable rarely exceeds a few milliamperes, such cables do not require the heavy conductors used in loudspeaker cables, but, on the other hand, become more sensitive to electromagnetic interference such as hum, noise, cross-talk, and air borne radio frequency signals. Basic protection from interference includes optimizing the geometry of signal carrying conductors by arranging them co-axially or as twisted pairs, and, in addition, individual conductors or groups of conductors are often surrounded by shielding which is connected to ground or to the chassis of interconnected components.

Besides interference from the outside, the weak signals traveling in interconnect cables may be affected by noise generated in the cable itself caused by interaction between wire strands, so called microphony, and by tribo-electric charges and discharges in the dielectric materials which separate the signal carriers from one another and their shielding. Tribo-electric charges may be generated by even minute movement or compression of cables or by ground loops and, in addition, charge build up may be caused by the signals traveling in the cables.

In order to improve the noise to signal ratio, often balanced constructions are preferred over single ended cables, either by replacing the single center conductor in a coaxial cable with a twisted pair or by arranging the second signal carrier as a braided tube concentrically surrounding the center carrier, the whole construction again surrounded by a braided, grounded shield. The relative capacitance and series inductance of such cables, and thus their characteristic impedance, are dependent on dimensions, geometry, and the characteristics of the dielectric and all of these affect cable performance.

The term "strip line" describes a kind of transmission line which is similar in many respects to a coaxial cable. It may, in fact, be regarded as a simple variation of the coaxial line, although it has a great many practical advantages over the latter. The basic strip line is uniform in cross section and consists of a thin center conductor of rectangular cross section situated between two parallel conductors of the same width or wider than the center conductor and serving as ground planes. The three layers in turn are insulated from one another by means of layers of a thin dielectric sheet. When energized, the field is largely confined to the region between the three parallel conductors with the field strength decreasing rapidly away from the strip at a rate relative to the distance between the plates. Thus, with conductors consisting of thin foil and separated by an even thinner dielectric, the outside field is close to zero and, by the same token, such a strip line is closed to a high degree towards interference from signals traveling in nearby lines and airborne RF signals.

In an audio system, interference may be directly audible or may enter amplifiers through feedback loops from either the input or output terminals. Thus, interfering radio frequency signals may audibly change the bias of amplifier stages and may result in indirect distortion of the output signal, and in some cases may cause overheating due to inaudible amplification of high frequency interference. This is the reason why good interconnect cables must be screened from or otherwise rendered insensitive to external magnetic field and RF signals.

A further limitation of flat cables is that, due to the solid conductors employed, the flat cables can only be bent and coiled perpendicularly to the axis of bending and this can constitute a problem when the cables are used as, e.g., microphone or instrument cables.

Accordingly, it is a principal object of the present invention to provide an interconnect cable that eliminates or considerably reduces signal distortion, noise, and interference from surrounding electric and magnetic fields.

It is a further object of the invention to provide such an interconnect cable that is able to transfer signals at frequencies beyond the audile range without distortion such as high frequency roll-off and frequency dependent phase shift.

It is another object of the invention to provide such an interconnect cable that is relatively insensitive to electromagnetic interference such as hum, noise, cross-talk, and air borne radio frequency signals.

An additional object of the invention is to provide such an interconnect cable that is relatively unaffected by noise generated in the cable itself.

Yet a further object of the invention is to provide such an interconnect cable that is insensitive to surrounding magnetic fields and radio frequency signals.

Yet another object of the invention is to provide such an interconnect cable that can be bent and coiled other than perpendicularly to the axis of bending.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an audio signal interconnect cable, comprising: at least two, thin, flat conductors and a flexible jacket surrounding said at least two, thin, flat conductors. Each of said at least two, thin, flat conductors may have a width on the order of from about 2 to about 6 mm and a thickness on the order of from about 50 to about 100 microns.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
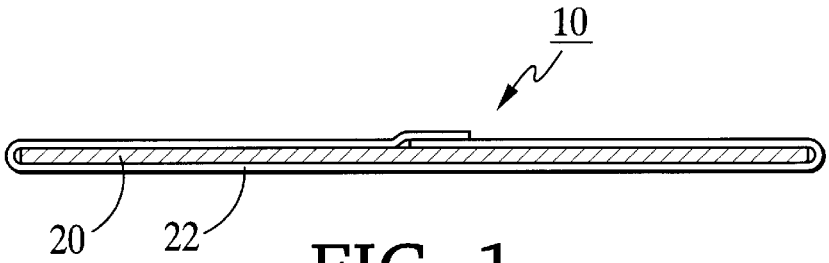
FIG. 1 is an enlarged cross-sectional view through a preferred embodiment of a conductor as used in cables according to the invention.

Reference should now be made to the drawing figures on which similar or identical elements are given consistent identifying numerals throughout the various figures thereof, and on which parenthetical references to figure numbers direct the reader to the view(s) on which the element(s) being described is (are) best seen, although the element(s) may be seen on other figures also.

In summary, the invention replaces the conventional stranded conductors with thin, narrow ribbons of solid copper or silver separated from one another by a thin dielectric or individually enclosed in a micro-thin layer of film insulation, and sandwiched together in close mutual contact. The cable according to the invention may contain just the two conductors, or an additional central strip conductor serving as a ground plane, and an outer protective jacket of a suitable polymer and/or helical spring may be provided.

Referring first to FIG. 1, there is illustrated a flat, solid ribbon conductor, shown enlarged 25 to 50 times, and generally indicated by the reference numeral 10. Conductor 10 includes a conductive core 20 which is a metal foil and which may be made of copper or silver measuring on the order of 2 to 6 mm wide by 50 to 100 microns thick. Conductive core 20 is enclosed in a film 22 of a thin dielectric which may be applied as multiple coats of a suitable varnish or as a discrete film which is folded around the conductive core and bonded in place.

Figure 2:
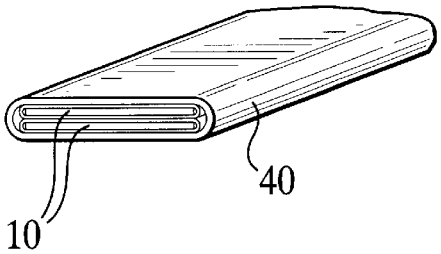
FIG. 2 is an enlarged isometric view of one preferred embodiment of an audio interconnect cable according to the invention, this embodiment having two strip conductors.

As illustrated on FIG. 2, two conductors 10 (FIG. 1) as described are then placed together in close mutual contact and surrounded by a flexible polymer jacket 40.

Figure 3:
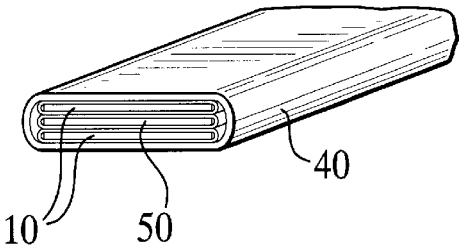
FIG. 3 is an enlarged isometric view of another preferred embodiment of an audio interconnect cable according to the invention, this embodiment having two conductors placed on each side of a central ground plane.

FIG. 3 illustrates a balanced version of the invention in which two conductors 10 (FIG. 1) are placed on either side of a similarly constructed third conductor 50, which serves as a ground plane. Conductors 10 and 50 are surrounded by flexible polymer jacket 40. For audio applications, typically the signal carrying conductors 10 are made of silver and the ground plane conductor 50 is made of copper.

Figure 4:
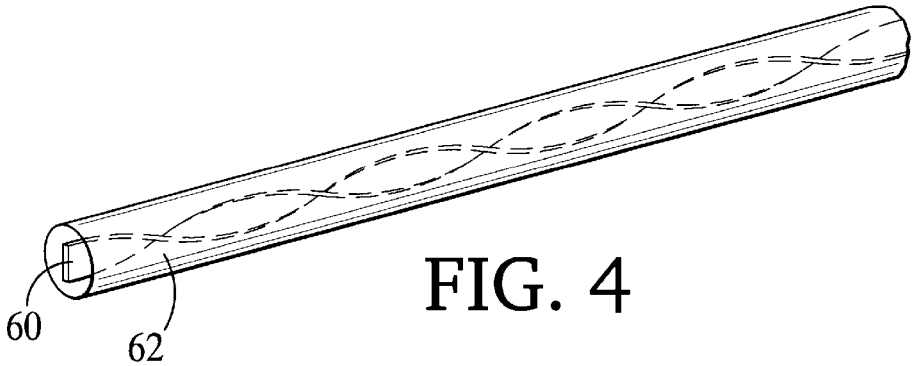
FIG. 4 is an isometric view of a cable as shown in FIGS. 1 or 2, twisted and enclosed in a polymer jacket.

As is illustrated on FIG. 4, the preferred plane of bending of the flat conductor may be eliminated for conveniently coiling the cable by providing a group 60, of two or three conductors with a continuous twist, before enclosing the group of conductors in a jacket 62 of a suitable polymer, having, preferably, a round cross section. The twisting may have a pitch in the order of 5 to 20 times the width of the conductor per fill revolution. Preferably, polymer jacket 62 may be extruded in place to provide maximum protection against crushing the conductor bundle.

Figure 5:
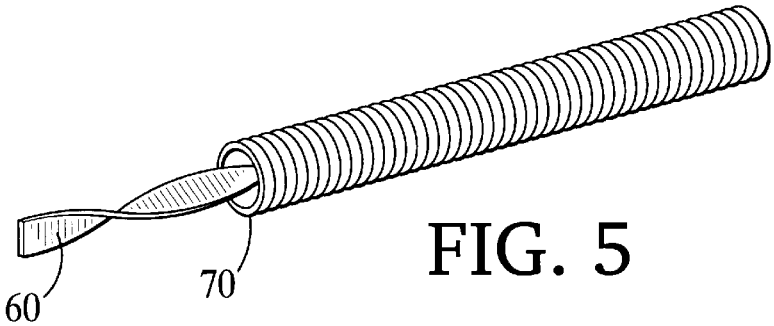
Fig.5 is an isometric view of a cable as shown in FIGS. 1 or 2, twisted and enclosed in a continuously wound helix made of a suitable metal wire.

FIG. 5 illustrates that a different way of protecting flat conductors is to enclose twisted bundle 60 in a continuous helical closely wound spring 70. Spring 70 may be wound of hardened steel wire like music wire which selected to provide simultaneous strength against crushing as well as acting as shielding the cable against electromagnetic and radio frequency interference. Typically, jacket spring 70 may be made of 0.026" diameter wire wound into a spiral with an outside diameter of around 0.25". Twisted bundle 60 is placed loosely inside spring jacket 70 and is able to turn and move relative to the jacket while the cable is moved around and being coiled and uncoiled. Conductor bundle 60 may be placed loosely inside spring 70 or be jacketed with a flexible polymer jacket 62 (FIG. 4) before adding the coil spring jacket.

The benefits of the described construction are the following:

(1) A total elimination of microphony from galvanic strand interaction, due to the use of solid conductors.

(2) Since the field extends only negligibly beyond the edges of the sandwich, the active dielectric is largely limited to the thin layers of film placed between the strip conductors. Quantitywise, this amounts to only a few percent of the active insulation compared with cables of conventional construction and the result is greatly reduced stored charges and an almost complete elimination of tribo-electric noise.

(3) An unsurpassed low series inductance caused by placing the ribbon conductors only microns apart. This ensures short rise-time, virtually eliminating high frequency roll-off.

(4) Further, according to the invention, a truly balanced construction can be achieved by placing a ground plane, also in the form of a narrow, solid ribbon conductor, between the two signal carriers. The effect of this three-layer geometry is improved interference rejection and signal to noise ratio.

(5) A continuous twist can be applied to the flat conductor sandwich as it is being jacketed in order to eliminate any preferred plane of bending.

(6) An additional benefit from twisting the conductor bundle is a further improvement in interference rejection along the same lines as that achieved in twisted pairs used universally in telephone systems and other forms of telecommunication.

Figure 6:
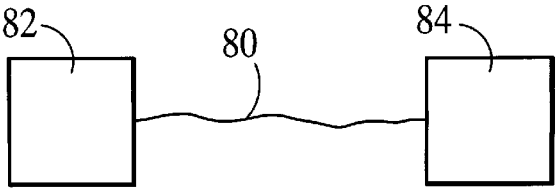
FIG. 6 is a schematic/block representation of the use of an audio interconnect cable, according to the invention, operatively connecting a source and a load.

As is illustrated on FIG. 6, audio interconnect cables as described above can be used to carry signals between a source and a pre-amplifier or a power amplifier. Here, an audio interconnect cable 80 is employed to operatively connect a source 82 to a load 84. Source 82 may be assumed to be, for example, a microphone or a tape or record player and load 84 may be assumed to be, for example, a pre-amplifier or an amplifier.

Trials at professional recording studios have demonstrated that the cables of the invention are specifically beneficial as microphone cables, providing a startling transparency and stereo definition as well as a dead silent background. It is a drawback, however, that the composition with its three micro thin conductors may be easily damaged in a studio environment. Besides the risk of chafing, the fragile three layer ribbon tends to buckle when coiled and uncoiled and may be crushed by traffic loads and rough handling. These drawbacks are easily overcome by employing the embodiment shown on FIG. 5 in which bundle 60 is encased in spring jacket 70.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. An audio signal interconnect cable conductor, comprising:

(a) at least two, thin, flat, solid, substantially similarly dimensioned conductors each having dimensions on the order of 2 to 6 millimeters wide by 50 to 100 microns thick and each enclosed in a film of thin dielectric;

(b) said at least two conductors being superimposed sandwich-like and in close mutual contact; and (c) said at least two conductors being twisted about a major axis thereof.

2. An audio signal interconnect cable conductor, as defined in claim 1, further comprising: a flexible polymer jacket surrounding said at least two conductors.

3. An audio signal interconnect cable conductor, as defined in claim 1, further comprising: a third, similarly dimensioned conductor enclosed in a film of thin dielectric disposed between said at least two conductors, in close mutual contact therewith, and serving as a ground plane therefor.

4. An audio system, comprising:

(a) an audio source;

(b) an amplifier; and (c) an audio interconnect cable attached to said audio source and to said amplifier, said audio interconnect cable comprising at least two, thin, flat, solid, substantially similarly dimensioned conductors each having dimensions on the order of 2 to 6 millimeters wide by 50 to 100 microns thick and each enclosed in a film of thin dielectric; said at least two conductors being superimposed sandwich-like and in close mutual contact; and said at least two conductors being superimposed about a major axis thereof.

5. An audio system, as defined in claim 4, further comprising: a flexible polymer jacket surrounding said at least two conductors.

6. An audio system as defined in claim 4, further comprising: a third, similarly dimensioned conductor enclosed in a film of thin dielectric disposed between said at least two conductors, in close mutual contact therewith, and serving as a ground plane therefor.

* * * * *